US006180899B1

(12) United States Patent
Passow

(10) Patent No.: US 6,180,899 B1
(45) Date of Patent: Jan. 30, 2001

(54) SEMI-BIFURCATED ELECTRICAL CONTACTS

(75) Inventor: Christian H. Passow, Batavia, IL (US)

(73) Assignee: Siemens Energy & Automation, Inc., Alpharetta, GA (US)

( * ) Notice: Under 35 U.S.C. 154(b), the term of this patent shall be extended for 0 days.

(21) Appl. No.: 09/224,787

(22) Filed: Jan. 4, 1999

(51) Int. Cl.[7] ..... H01H 15/06
(52) U.S. Cl. ..... 200/243; 200/248
(58) Field of Search ..... 200/243, 245, 200/248, 447

(56) References Cited

U.S. PATENT DOCUMENTS 3,529,109 * 9/1970 Cross ..... 200/243
4,006,322 * 2/1977 Gallatin et al. ..... 200/243 X

* cited by examiner

*Primary Examiner*—Renee Luebke

(57) ABSTRACT

A double break switch construction for use in an electrical apparatus and suitable for both high power and low voltage-low current applications includes a base (10), first and second electrical contacts (36,38), mounted on the base (10) in spaced relation to one another, and an elongated, resilient, electrically conductive bar (48,100) having opposed ends (50,52). Two pairs of spaced electrical contacts (80,82); (90,92) are located on one side of the bar (48,100) with one pair of each of the ends (50,52) thereof. The bar (48,100) is aligned with the contacts (36,38) to bridge the same and the mounting post (54,60) engages the bar (48,100) generally centrally thereof and is movably mounted on the base (10) for moving the bar (48,100) toward and away from the contacts (36,38). A slot (94) is located in the bar (48,100) and extends in the direction of elongation thereof and between the contacts (90,92). The contact bar (48,100) is imperforate (84) between the contacts (80,82).

10 Claims, 2 Drawing Sheets

SEMI-BIFURCATED ELECTRICAL CONTACTS

FIELD OF THE INVENTION

This invention relates to a double break switch construction, and more specifically, to a double break switch employing semi-bifurcated contacts.

BACKGROUND OF THE INVENTION

A variety of electrical switching applications desirably include the use of so-called double-break electrical contacts. Double break electrical contacts typically employ two spaced stationary contacts along with a movable contact that electrically bridges the two stationary contacts. The movable contact typically includes an electrically conductive, resilient bar or backing, typically made of metal, and mounting two spaced contacts that are aligned with the two stationary contacts. An actuator is employed to move the bar toward and away from the stationary contacts.

Applications include so-called "high power" applications and so-called "low voltage-low current" or "fidelity" applications. In a high power application, to achieve a long electrical life, a certain minimum cross-sectional area of the bar or backing of the movable contact is required. The cross-sectional area is selected so as to minimize heat rise when the bar is conducting a current between the two stationary contacts. Not untypically, the width of the movable contact bar is constrained and so, in effect, the minimum cross-sectional area of the bar translates into a minimum bar thickness.

In high power applications, oxide films and foreign particles that may lodge on the contacts and tend to separate the same are typically burnt away during switching and consequently, do not present a serious problem. On the other hand, a low voltage-low current applications, such oxide films or foreign particles may prevent the switching operation from completing itself when the contacts fail to make electrical contact with one another due to the presence of such films or particles. Consequently, ineffective or unreliable control functions may result. Consequently, so-called bifurcated contacts are frequently used in low voltage, low current applications.

By way of application, all rigid bodies resting against another rigid body contact at only three points. In non-bifurcated double-break contacts, the contact at one end of the bar will touch its respective stationary contact at two points, but the contact at the other end of the bar will touch its stationary contact at only one point. If there is a non-conductive oxide film or foreign particle at the single contact point, the bar will not electrically bridge the stationary contacts.

Flexible bodies, however, can come to rest against the rigid body at more than three points. Consequently, in conventional bifurcated, double break contacts, wherein four contacts are located on the bar, all four contacts will touch their respective stationary contacts. As a result, proper contact is lost only if both of the contacts at one end of the bar simultaneously land on areas of non-conductive, oxide film or on foreign particles. In order to achieve reliable contact, it is necessary that the split legs of the contact bar be sufficiently flexible, given the contact force supplied to the bar. The flexibility of the legs is, in turn, a function of the thickness of the backing and the length of the legs. Not infrequently, the movable bars are mounted on a post or alternatively, mounted between two posts. In either case, particularly when the bar is mounted on a post, considerable difficulty may be experienced in designing an effective bifurcated contact when (a) a minimum contact bar thickness is required to meet a "high power" specification; or (b) the length of the contact mounting legs on the bar is limited by the total length of the bar; or (c) the length of the backing legs is limited by the presence of a hole or notch for receiving a post or posts. Consequently, when it is desired to design a switching system employing bifurcated contacts and useful in both high power and in low voltage, low current applications, these factors must be considered.

The present invention is intended to provide a new and improved, double break switch construction which eliminates design problems in designing double break switch assemblies for use in both high power and low voltage-low current applications.

SUMMARY OF THE INVENTION

It is the principal object of the invention to provide a new and improved double break electrical switch assembly. More specifically, it is the principal object of the invention to provide a double break switch assembly that may be readily employed in both high power and low voltage-low current applications.

According to one embodiment of the invention, a double break switch construction for use in electrical apparatus and suitable for both high power and low voltage-low current applications is provided. The switch construction includes a base with first and second electrical contacts fixedly mounted on the base in spaced relation to one another. The switch also includes an elongated, resilient, electrically conductive bar having opposed ends. Two pairs of spaced electrical contacts are located on one side of the bar, one pair at each end thereof. The bar is aligned with and movable toward and away the first and second contacts to bridge the same with one of the pairs of contacts being engageable with the first contact and other pair of contacts being engageable with the second contact. The mounting device engages the bar generally centrally thereof and in turn is movable on the base for moving the bar toward and away from the first and second contacts. A slot is located in the bar and extends along the direction of elongation thereof and between the contacts of one of the contact pairs only. The bar is imperforate between the contacts of the other pair.

In a preferred embodiment, the slot extends fully to the end of the bar at which the one pair of contacts is located.

In one embodiment of the invention, the bar includes a generally central opening which receives the mounting device and the slot extends to the central opening.

In one embodiment, the mounting device includes a post engaging the bar in an opening therein. In another embodiment, the mounting devices includes two posts sandwiching the bar.

Other objects and advantages will be apparent from the following specification taken in connection with the accompanying drawings.

DESCRIPTION OF THE PREFERRED EMBODIMENT

Figure 1:
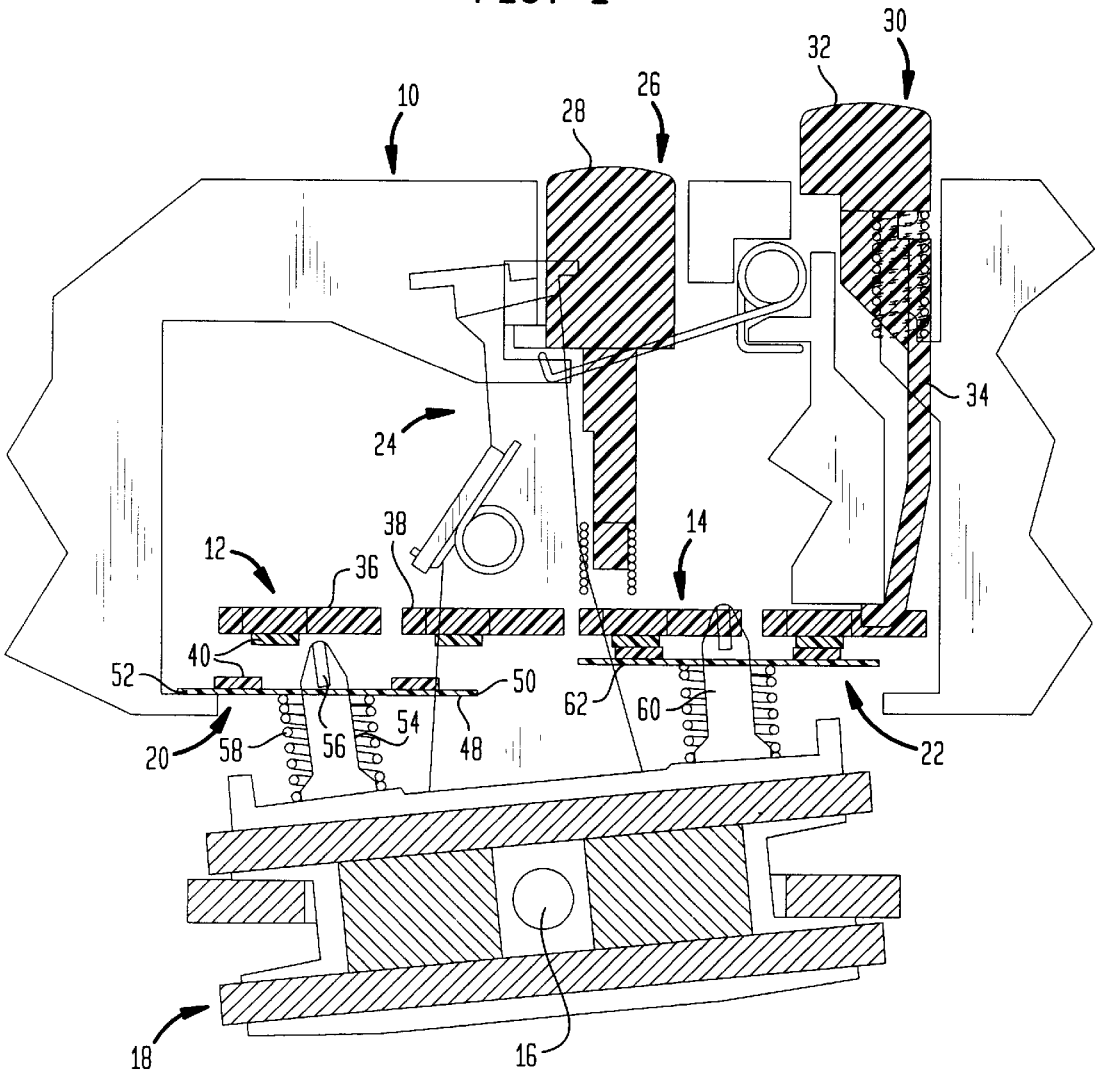
FIG. 1 is a somewhat schematic, sectional view of an operating mechanism for an overload relay and embodying double break switch contact assemblies made according to the invention.

An exemplary embodiment of a double break switch construction made according to the invention is illustrated in FIG. 1 in the environment of an overload relay of the type disclosed in the commonly assigned application of Christian Passow, entitled "Trip Mechanism for an Overload Relay", Ser. No. 08/838,904, filed Apr. 11, 1997 and now abandoned, the entire disclosure of which is herein incorporated by reference. However, it is to be understood that the switch assembly of the invention may be used with efficacy in other environments and no limitation to any specific environment is intended except as insofar as set forth in the appended claims.

The overload relay is shown in a reset position and includes a housing, generally designated 10, mounting a first set of normally open, fixed contacts, generally designated 12 and a second set of normally closed, fixed contacts, generally designated 14. The housing 10 includes a pivot pin 16 upon which an elongated, bi-stable armature, generally designated 18, is pivoted. The armature 18 carries a first set of movable contacts, generally designated 20, and a second set of movable contacts, generally designated 22, which cooperate with the fixed contacts 12 and 14 respectively. As more fully described in the above-identified application of Passow, a latch lever, generally designated 24, is connected to the armature 18 to be movable therewith and thus will rock about the pivot 16 between the two stable positions of the armature 18.

The housing mounts a manual operator, generally designated 26, which includes a push button 28. The same is mounted for reciprocating movement within the housing 10 generally toward and away from the latch lever 14. A manual stop operator, generally designated 30, is also reciprocally mounted within the housing 10 and includes an upper push button 32 and a depending, lower shank 34 which is operative to open the normally closed contacts 14,22 under those conditions described in the above-referenced Passow application.

Figure 2:
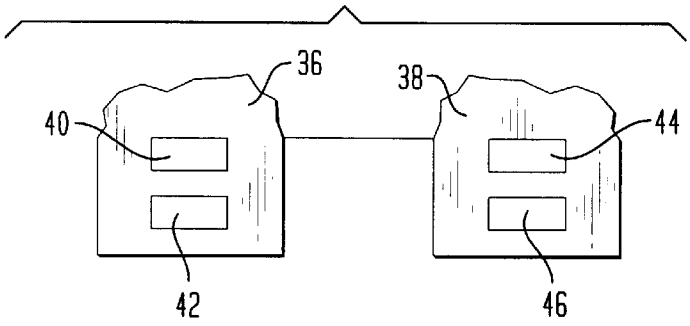
FIG. 2 is a bottom view of fixed contacts employed in the assembly.

Turning to FIG 2, and the fixed contacts 12,14, since the same are identical, only the contacts 12 will be described. A pair of fingers 36,38, extend in spaced relation from part of the housing to overlie the movable contacts 20. The finger, on its underside, includes two spaced contacts 40,42 which are in side-by-side relation. The finger 38 mounts two similar contacts 44,46, which are also in side-by-side relation. The contacts 40,42 are electrically connected to one another as are the contacts 44,46. In most instances the contacts 40,42 and the contacts 44,46 will not be as shown. Preferably each will be a single, large contact for simplicity.

The movable contact 20 includes an elongated contact bar 48 having opposed ends 50 and 52. As will be seen, the same is operative to bridge the contacts 40,42 on the one hand and the contacts 44,46 on the other and establish an electrical connection between all four of the contacts 40,42,44,46 when in a closed position.

The contact bar 48 is mounted on an upstanding post 54 which includes a pair of oppositely directed cross members 56 at its upper end (only one of which is shown) which act as a fulcrum for the contact bar 48. A coil spring 58 about the post 54 acts to bias the contact bar 48 against the cross members 56.

In the embodiment illustrated, a post 60 is identical to the post 54 and mounts the contact bar 62 forming part of the movable contacts 22 in the same fashion. In the interest of brevity, it will not be re-described.

Figure 3:
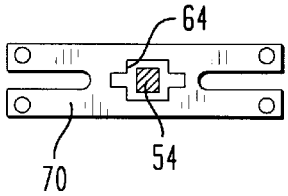
FIG. 3 (PRIOR ART)
FIG. 3 is a sectional view of a central post mounting a conventional contact bar.
Figure 4:
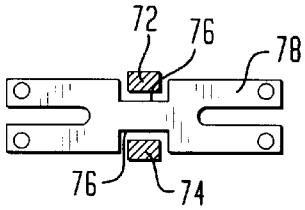
FIG. 4 (PRIOR ART)
FIG. 4 is a view similar to FIG. 3, but illustrating a pair of posts sandwiching and mounting a conventional contact bar.

As illustrated in FIG. 3, the post 54 extends through an opening 64 in a contact bar designated 70. However, as illustrated in FIG. 4, rather than extending the post 54 through an opening 64, a pair of posts 72, 74, may be received in respective notches 76 in a contact bar 78 to loosely sandwich contact bar 78 and achieve the same function.

Figure 5:
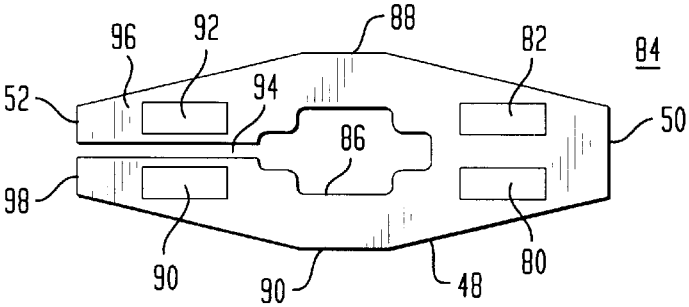
FIG. 5 is a plan view of one embodiment of a contact bar made according to the invention.

Turning now to FIG. 5, one embodiment of the contact bar 48 of the invention will be described. Again, the contact bar 48 is identical to the contact bar 62 so only the former will be described.

The contact bar 48 is in the form of a flattened octagon having opposed ends 50 and 52. Consequently, the contact bar 48 is elongated. It will, of course, be made of a resilient, electrically conductive material, typically metal.

Adjacent the end 50, a pair of contacts 80,82 are located. The contacts 80 and 82 are spaced the same spacing as the contacts 44,46, the arrangement being that when installed as illustrated in FIG. 1, the contact 80 will close against the contact 44 and the contact 82 will close against the contact 46. It is to be particularly noted that in the region 84 between the contacts 80,82, the contact bar 48 is imperforate, that is, solid. No material has been removed from this area.

The center of the contact bar 48 has a post receiving aperture 86 for receipt of the post 54 or the post 60. The aperture 86 is centrally located. It is to be noted that if notches similar to the notches 76 were to be used, they would be centrally located in sides 88,89, of the contact bar 48.

Adjacent the end 52 of the contact bar 48, contacts 90,92 are located. The contacts 90,92 are spaced from one another in a direction generally transverse to the direction of elongation of the contact bar 48 as are the contacts 80,82 and are aligned and spaced so as to close against the contacts 40,42 respectively.

In the embodiment illustrated in FIG. 5, the contact bar 48 is semi-bifurcated in the sense that a slot 94 is located therein and the same extends from the central opening 86 all the way to the end 52.

The contact bar illustrated in FIG. 5 will be as effective as conventional, bifurcated contact bars such as those shown in FIGS. 3 and 4 because the same will still electrically bridge the two stationary contacts on each of the fingers 36,38 unless both contacts at one end of the contact bar 48 simultaneously land on an area of non-conductive film or a foreign particle.

Should one of the contacts 90,92 at the end 52 of the contact bar 48 containing the slot 94 land on a non-conductive area or a foreign particle, the legs 96,98 defined by the existence of the slot 94 may flex and allow the other contact 90,92 to touch and make electrical contact with the associated stationary contact 40,42. If, on the other hand, one of the contacts 80,82 at the imperforate end 50 of the contact bar 48 encounters a non-conductive film or a particle, the legs 96,98 will nonetheless flex, allowing the entire contact bar 48 to tilt on the post 54 or 60 allowing the other of the contacts 80,82 to electrically contact a corresponding one of the fixed contacts 44,46. In this case, the contact bar 48, will act like a rigid body and make contact at three points, but flexing of the legs 96,98 assures that the two contacts 90,92 thereat will serve effectively as only a single one of the three points of contact. Consequently, both the contacts 80,82 at one end 50 and the contacts 90,92 at the end 52 will always come to rest against their respective stationary contacts just as in a conventional bifurcated contact as shown in FIGS. 3 or 4. In other words, to achieve the desired flexing, it is necessary that the slot 94 extend between the contacts to the end 52 of the bar or substantially thereto. Consequently, a contact bar such as that shown in 48 made according to the invention desirably performs as a bifurcated, double break switch contact suitable for use in the low voltage-low current circuits. At the same time, because the legs 96,98 extend over the greater part of the total length of the contact bar 48, allowing the legs 96,98 to be significantly more flexible, for a given thickness, than would be the case with a conventional contact bar, the same remains capable of being made relatively small and yet operating in a high power circuit without appreciable heat up that could shorten its useful life.

From the foregoing, it will be readily appreciated that a contact bar 48,100 made according to the invention, provides an ideal means of solving design problems associated with double break switch assemblies that are intended to be used in both high power and low voltage-low current applications.

What is claimed is:

1. A double break switch construction for use in an electrical apparatus and suitable for both high power and low voltage-low current applications and comprising:

a base;

first and second electrical contacts fixedly mounted on said base in spaced relation to one another;

an elongated, resilient electrically conductive bar having opposed ends;

two pairs of spaced electrical contacts on one side of said bar, one pair at each end thereof;

said bar being aligned with and movable toward and away from said first and second contacts to bridge the same with one of said pairs being engageable with said first contact and the other pair being engageable with said second contact;

a mounting device engaging said bar generally centrally thereof and in turn being movably mounted on said base for moving said bar toward and away from said first and second contacts; and a slot in said bar extending along the direction of elongation thereof and between the contacts of one of said pairs only, said bar being imperforate between the contacts of the other of said pairs.

2. The double break switch construction of claim 1 wherein said slot extends substantially to the end of said bar at which said one pair of contacts is located.

3. The double break switch construction of claim 2 wherein said slot terminates at the end of said bar at which said one pair of contacts is located.

4. The double break switch construction of claim 1 wherein said bar includes an opening intermediate the opposed ends of said bar for receiving said mounting device; and wherein said slot extends to said opening.

5. The double break switch construction of claim 1 wherein each of said first and second contacts is made up of two spaced contacts in side-by-side relation.

6. The double break switch construction of claim 1 wherein said mounting device includes a post engaging said bar at an opening therein.

7. A double break switch construction for use in an electrical apparatus and suitable for both high power and low voltage-low current applications and comprising:

a base;

first and second electrical contacts fixedly mounted on said base in spaced relation to one another;

an elongated, resilient electrically conductive bar having opposed ends;

two pairs of spaced electrical contacts on one side of said bar, one pair adjacent each end thereof; said bar being aligned with and movable toward and away from said first and second contacts to bridge the same with the contacts of one of said pairs being engageable with said first contact and the contacts of the other pair being engageable with said second contact;

a mounting post engaging said bar generally centrally thereof in an aperture therein and in turn being movably mounted on said base for moving said bar toward and away from said first and second contacts; and a slot in said bar extending along the direction of elongation thereof from said aperture and toward an end of said bar mounting said one contact pair and between the contacts of said one pair, said bar being imperforate between the contacts of the other of said pairs.

8. A double break switch construction for use in an electrical apparatus and suitable for both high power and low voltage-low current applications and comprising:

a base;

first and second electrical contacts fixedly mounted on said base in spaced relation to one another;

an elongated, resilient electrically conductive bar having opposed ends;

two pairs of spaced electrical contacts on one side of said bar, one pair adjacent each end of thereof;

said bar being aligned with and movable toward and away from said first and second contacts to bridge the same with the contacts of one of said pairs being engageable with said first contact and the contacts of the other pair being engageable with said second contact;

a mounting device engaging said bar generally centrally thereof between said opposed ends and in turn being movably mounted on said base for moving said bar toward and away from said first and second contacts; and a slot in said bar extending along the direction of elongation thereof from near said mounting device toward and end of said bar mounting said one pair and between the contacts of said one pair, said bar being imperforate between the contacts of the other of said pairs.

9. The double break switch construction of claim 8 wherein said slot extends and opens to the end of said bar mounting said one pair so that the contacts of said one pair are mounted on respective free ends of spaced fingers of said bar.

10. The double break switch construction of claim 8 wherein said slot terminates intermediate the ends of said bar in an enlarged opening receiving said mounting device.

* * * * *